US007584854B2

(12) United States Patent
Chandaria

(10) Patent No.: US 7,584,854 B2
(45) Date of Patent: Sep. 8, 2009

(54) SHIPPING AND DISPLAY ASSEMBLY FOR COMPLEMENTARY PRODUCTS

(75) Inventor: Ashok V. Chandaria, Nairobi (KE)

(73) Assignee: Kitaru Innovations Inc., Lascelles, St. James (BB)

( * ) Notice: Subject to any disclaimer, the term of this patent is extended or adjusted under 35 U.S.C. 154(b) by 261 days.

(21) Appl. No.: 11/580,808

(22) Filed: Oct. 13, 2006

(65) Prior Publication Data

US 2007/0090015 A1 Apr. 26, 2007

Related U.S. Application Data

(60) Provisional application No. 60/729,143, filed on Oct. 20, 2005.

(51) Int. Cl.
*B65D 71/00* (2006.01)

(52) U.S. Cl. ..... 206/736; 206/391; 206/774; 206/443; 206/575; 206/411; 229/122

(58) Field of Classification Search ..... 206/736, 206/495.5, 745, 767, 216, 730, 446, 731, 206/732, 769, 774, 303, 443, 391, 394, 411, 206/408, 575, 225; 229/120.02, 122, 164, 229/240, 242

See application file for complete search history.

(56) References Cited

U.S. PATENT DOCUMENTS 2,015,278 A * 9/1935 Meyer ..... 229/120.18
4,058,206 A * 11/1977 Morse et al. ..... 229/241
4,407,442 A * 10/1983 Watson et al. ..... 229/120.18
5,054,612 A * 10/1991 Meyer, Jr. ..... 206/233
5,167,324 A * 12/1992 Miller ..... 206/738
5,259,631 A * 11/1993 Brande ..... 229/121
5,337,894 A * 8/1994 Ivey ..... 206/370
5,487,504 A * 1/1996 Baird ..... 229/120.17
5,520,325 A * 5/1996 Quaintance ..... 229/120.26
5,524,815 A * 6/1996 Sheffer ..... 229/120.18
5,775,574 A * 7/1998 Whitnell ..... 229/120.18
5,826,728 A * 10/1998 Sheffer ..... 206/774
5,950,911 A * 9/1999 Naughton et al. ..... 229/109
6,123,197 A * 9/2000 Marquez et al. ..... 206/575
6,427,907 B1 * 8/2002 Espinoza et al. ..... 229/122
6,698,589 B1 * 3/2004 Johnson ..... 206/391
6,915,907 B2 * 7/2005 Myers ..... 206/782
2003/0234195 A1 * 12/2003 Earl et al. ..... 206/338
2004/0195299 A1 * 10/2004 Petrelli et al. ..... 229/120.15
2005/0000852 A1 * 1/2005 Taylor et al. ..... 206/736
2006/0249529 A1 * 11/2006 Smalley et al. ..... 221/305

* cited by examiner

*Primary Examiner*—Ehud Gartenberg
*Assistant Examiner*—Robert Poon
(74) *Attorney, Agent, or Firm*—Sand & Sebolt

(57) ABSTRACT

A shipping and display assembly for a plurality of complementary primary and secondary products such as wrapping paper and adhesive tape. The assembly includes a box having a first section and a second section which are connected together for shipping and are separable for displaying the products. The first section includes a first compartment for holding and displaying the primary products and a second compartment for holding and displaying the secondary products. The second section of the display assembly restrains the primary and secondary products within the first and second compartments during shipping and is removed from over the first and second compartments when the products are to be displayed.

9 Claims, 3 Drawing Sheets

SHIPPING AND DISPLAY ASSEMBLY FOR COMPLEMENTARY PRODUCTS

CROSS-REFERENCE TO RELATED APPLICATIONS

This application claims priority from U.S. Provisional Application Ser. No. 60/729,143, filed Oct. 20, 2005, the entire specification of which is incorporated herein by reference.

BACKGROUND OF THE INVENTION

1. Technical Field

This invention relates generally to shipping and display assemblies for off-shelf displaying of products in retail stores. More particularly, the invention relates to assemblies which utilize the shipping box as part of the display assembly. Specifically, the invention relates to a shipping and display assembly that utilizes the lower half of a shipping box to form a first compartment to support elongated retail products, such as wrapping paper, and that includes a second compartment having a plurality of partially enclosed shelves to display complementary retail products such as adhesive tape dispensers.

2. Background Information

The typical retail store groups related products on shelves or on hanger rods mounted on walls or other upright structures. The shelves typically hold boxed products and other items which are readily supported on the flat upper surface of the shelves. The depth of most shelves is limited so that elongated products do not conveniently fit thereon and must therefore be positioned parallel to the isle. This takes up an unacceptably wide shelf area in most stores. Furthermore, in the case of products such as wrapping paper, the product is typically wrapped around a cylindrical core and there is therefore a likelihood that the product will roll off the shelf and onto the floor. Hanger rods are typically used to display products such as those packaged in lightweight cardboard or plastic and which include hang-tags for hanging them from the hanger rods. Packaged products which are too small to place on shelves or which may be seasonal in nature are frequently hung from elongated clip strips. These are lightweight flexible plastic strips that are about one inch wide and between twenty and forty inches in length. Clip strips are typically die-cut to produce a plurality of upwardly extending single flaps disposed lengthwise along the strip. Each single flap is flanked by a pair of downwardly extending flaps to form a flap group to retain the product. The products are mounted to the clip strip by positioning the upper end of a cardboard backing sheet under the pair of flaps and inserting the single flap through the hanging hole of the backing sheet to support the product. The flap group retains the backing sheet on the clip strip yet allows the product to be easily removed from the clip strip by pulling the product away from the strip to deflect the flaps. The top of the clip strips typically include a hole to wire them to shelf supports and product displays in locations around the store. The clip strips therefore allow for the display of complementary products without requiring shelf space to be utilized for smaller or awkwardly packaged products adjacent the primary products.

There are, however, a number of drawbacks to using clip strips. Firstly, attachment of products to the clip strips is labor-intensive, requiring each individual product to be manually mounted to the flaps of the clip strips at the retail store. If the products come pre-mounted to the clip strips from the manufacturer of the product, the products often disengage from the flaps during transport to the retailer. The retailer must then manually reattach the products to the clip strips. This at least partially defeats the purpose of having the products sent to the store pre-attached. Secondly, only a limited number of products may be displayed on a clip strip depending on the number of flaps present, this being typically between about ten and thirty flap groups. Thirdly, when consumers remove the products from the clip strips it is easy to inadvertently disengage other products from the strip at the same time. Fourthly, once the flap group has been used to retain and dispense the product, the flaps tend to become weakened and deformed due to the bending involved in engaging and disengaging the products. Therefore, if the product is reattached, as is the case when the consumer decides against purchasing the product, or when the retailer desires to add additional products to the clip strip, the products may inadvertently fall of the strip because the flap groups cannot adequately support them. Finally, products displayed on clip strips typically look aesthetically unappealing because they tend to hang at various angles from the clip strips rather than neatly aligned with each other. As a result of these disadvantages of clip strips, many retailers are avoiding using clip strips for displays and many chain retailers are banning the use of clip strips in their stores.

Seasonal products, such as Christmas wrapping, are typically shipped to retailers in corrugated cardboard boxes. The wrapping paper is frequently displayed in a vertical position within the original shipping box with the top half of the box cut off to expose the rolls of wrapping paper. It is desirable to display the adhesive tape close to the wrapping paper so that the consumer is drawn to purchase the complementary products at the same time. Adhesive tape is typically packaged with a single roll of tape affixed to a backing sheet or with several rolls of tape or tape dispensers packaged in a small cardboard box that may be stood on a shelf or hung from a hung tag. However, the size of single rolls of adhesive tape and the multi-roll packages of tape are small and awkwardly packaged and this makes them difficult to stack easily and neatly on shelves. The adhesive tape dispensers on shelves tend to fall over, will not stay in straight rows and may fall onto the floor. Occupying valuable shelf space with such products is not cost-efficient and the displays tend to look untidy. Retailers therefore tend to hang the single rolls or boxed rolls from hanger rods positioned near the wrapping paper, or may hang the products on clip strips that are disposed near the wrapping paper display. The hanger rods need to be suspended from metal shelving and consequently this limits the retailers' ability to display the adhesive tape in the immediate vicinity of the wrapping paper displays. As mentioned previously, clip strip type displays tend to be untidy, labor intensive and not reusable. Some retailers have consequently resorted to simply providing a large bin near the wrapping paper displays into which they place hundreds of individual rolls of tape, single tape dispensers or packages of multiple rolls of tape or tape dispensers. These bins allow the retailer to position the complementary product close to the free-standing wrapping paper boxes. The bins also allow the consumer to change their mind and replace the product if they decide not to purchase it without having to expend time and energy to do so. The disadvantages of the bins, however, are that the take up valuable floor space, making the display area feel cramped, and the bins also tend to give the retail store an untidy appearance.

There is therefore still a need in the art for a shipping and display assembly which allows retailers to display complementary secondary products in the immediate vicinity of displays of primary products, while keeping the products neatly displayed and easily accessible to the consumer.

SUMMARY OF THE INVENTION

The device of the present invention is a shipping and display assembly for a plurality of complementary primary and secondary products such as wrapping paper and adhesive tape. The assembly includes a box having a first section and a second section which are connected together for shipping and are separable for displaying the products. The first section includes a first compartment for holding and displaying the primary products and a second compartment for holding and displaying the secondary products. The second section of the display assembly restrains the primary and secondary products within the first and second compartments during shipping and is removed from over the first and second compartments when the products are to be displayed.

BRIEF DESCRIPTION OF THE DRAWINGS

The preferred embodiment of the invention, illustrative of the best mode in which applicant has contemplated applying the principles, is set forth in the following description and is shown in the drawings and is particularly and distinctly pointed out and set forth in the appended claims.

DETAILED DESCRIPTION OF THE INVENTION

Figure 1:
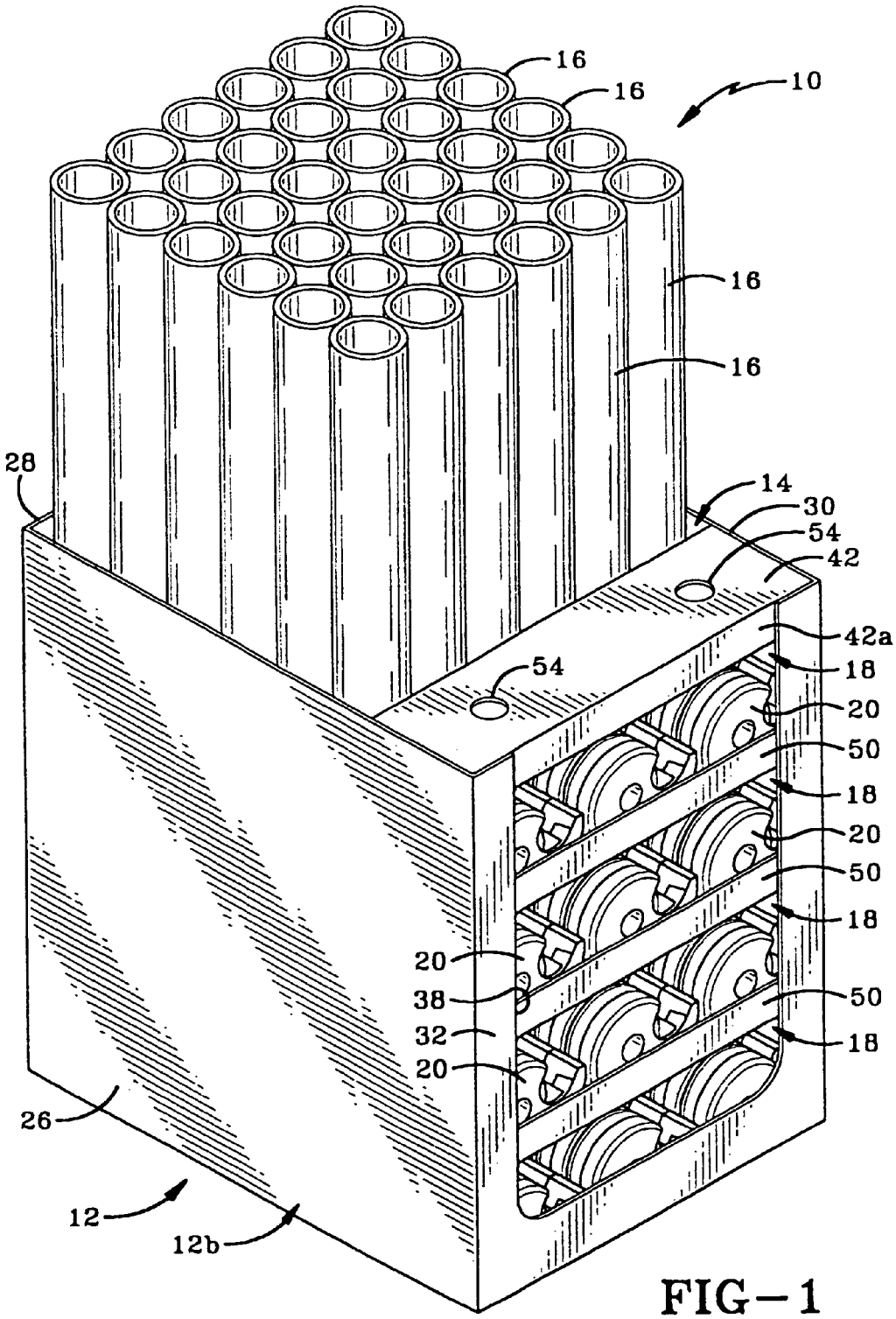
FIG. 1 is a perspective view of a shipping and display assembly in accordance with the present invention.
Figure 2:
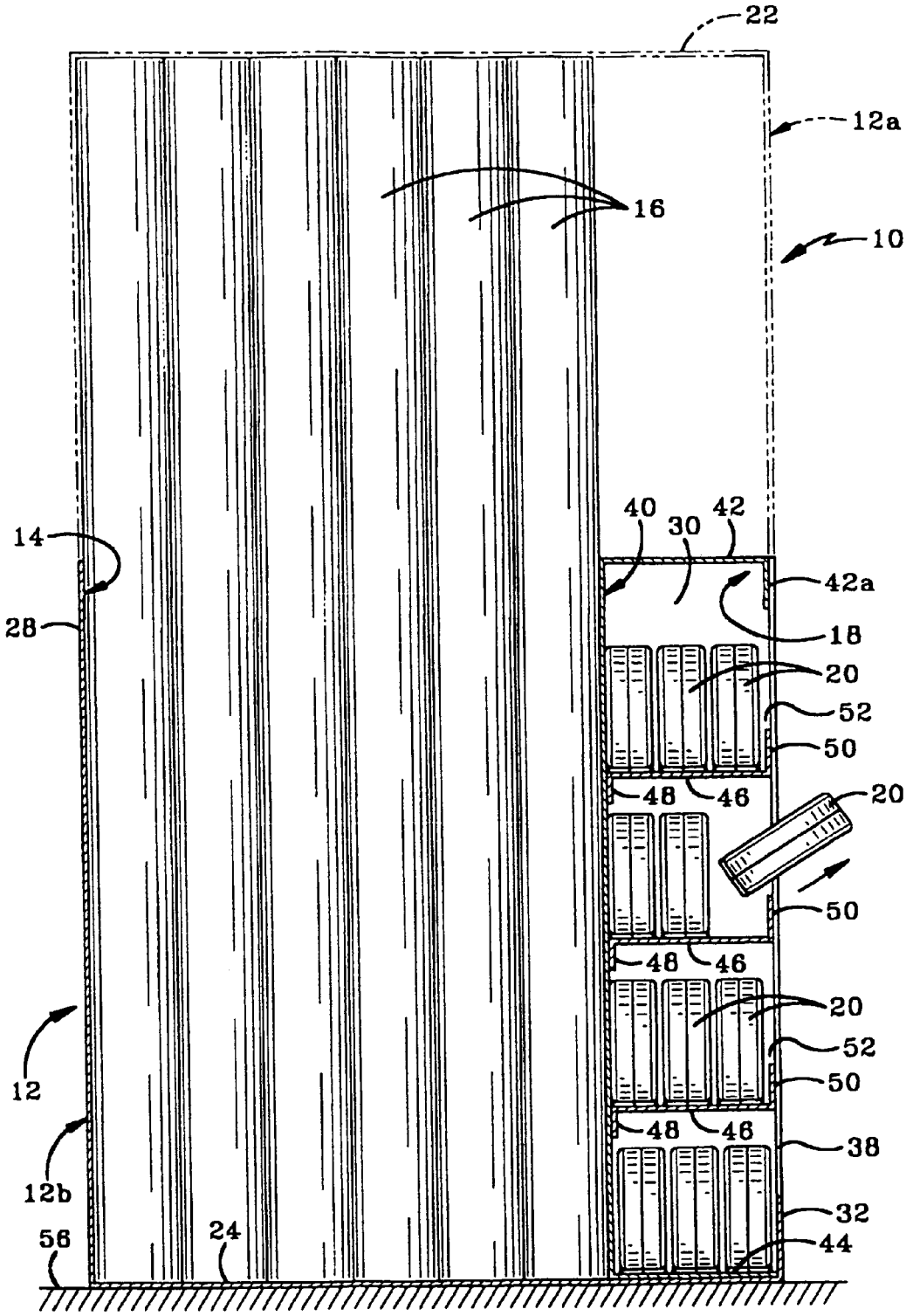
FIG. 2 is a cross-sectional side view of the shipping and display assembly of FIG. 1.
Figure 3:
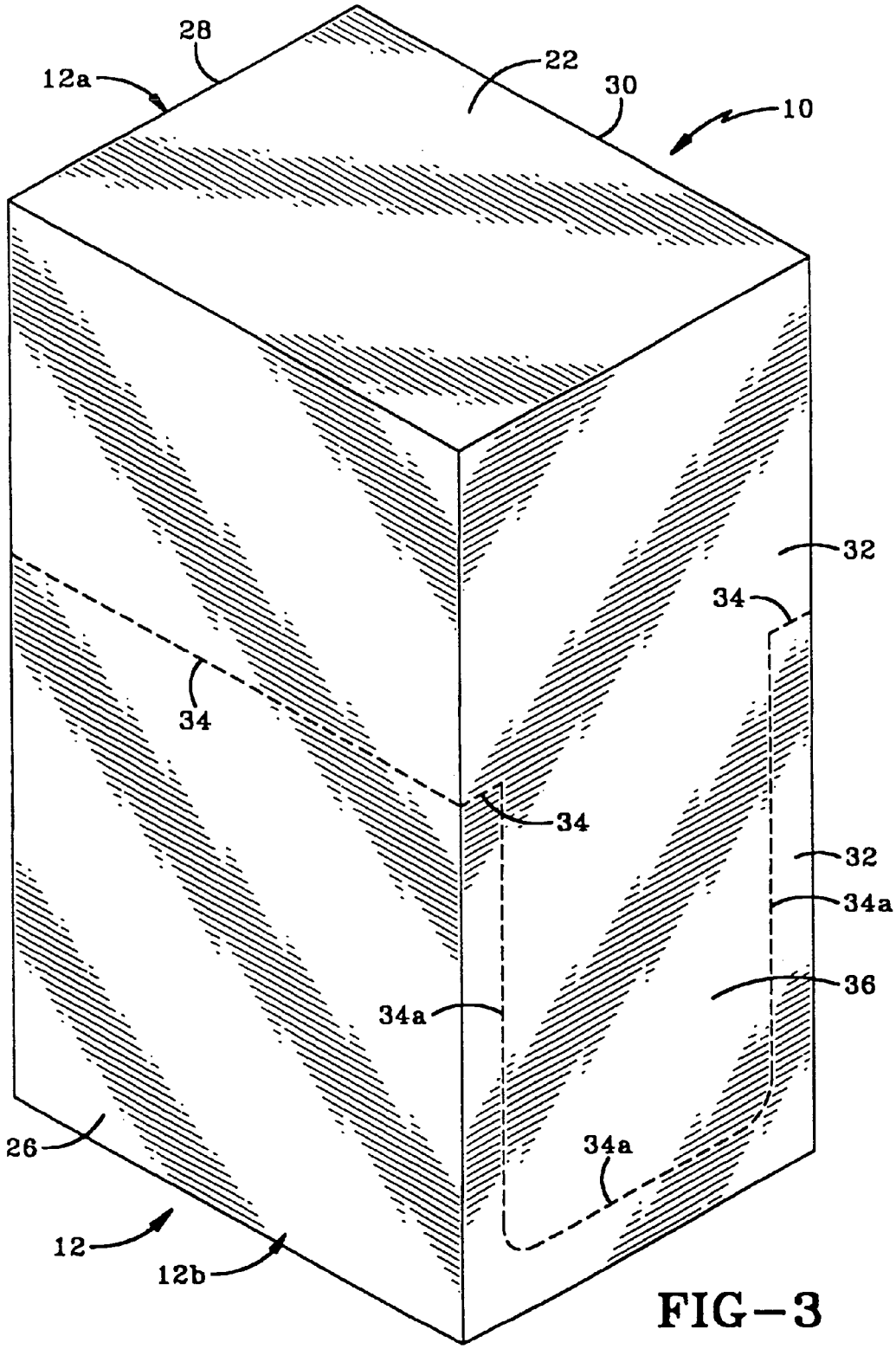
FIG. 3 is a perspective view of the shipping and display assembly showing how the box in the closed position for shipping to the retailer.

Referring to FIGS. 1-3 there is shown a display assembly in accordance with the present invention and generally indicated at 10. Display assembly 10 comprises a box 12 having a first compartment 14 for displaying a plurality of primary products 16 and a second compartment 18 for displaying a plurality of complementary secondary products 20. Box 12 preferably is manufactured from corrugated cardboard. The primary products 16 are elongated rolls of sheet material such as Christmas wrapping paper and the secondary products 20 are adhesive tape dispensers or rolls of adhesive tape.

As seen from FIGS. 2 & 3, box 12 has a top wall 22, a bottom wall 24 and side walls 26, 28, 30 and 32. A plurality of perforations 34 are formed in side walls 26, 28, 30 and 32 and box 12 may be separated therealong into an upper section 12*a* and a lower section 12*b*. Perforations 34*a* in side wall 32 extend downwardly into lower section 12*b* to form a tongue 36 that is integral with upper section 12*a* of box 12. When upper section 12*a* is separated from lower section 12*b*, tongue 36 detaches from lower section 12*b* forming a cutout area 38 in side wall 32 (FIG. 1). Upper section 12*a* covers and restrains the primary product 16 within box 12 during shipping and tongue 36 covers and restrains secondary products 20 within box 12 during shipping.

First compartment 14 is formed in lower section 12*b* of box 12 and is defined by a portion of bottom wall 24, a portion of side walls 26 and 30, side wall 28 and an intermediate wall 40. Intermediate wall 40 lies between side walls 28 and 32 and extends from side wall 26 to side wall 30. Primary products 16 are held within first compartment 14 during shipping and display.

Second compartment 18 is formed in lower section 12*b* of box 12 and is defined by a portion of bottom wall 24, a portion of side walls 26 and 30, intermediate wall 40 and the part of side wall 32 that remains when tongue 36 is removed. As seen in FIG. 2, an upper segment 42 and a lower segment 44 of intermediate wall 40 are folded toward side wall 32. Upper segment 42 forms the top wall of second compartment 18. A section 42*a* of upper segment 42 is folded downwardly toward bottom wall 24 of box 12 and is glued or otherwise secured to the inner surface of side wall 32, but is not secured to tongue 36. Lower segment 44 of intermediate wall 40 abuts bottom wall 24 of box 12 and is glued or otherwise secured to bottom wall 24. A plurality of shelves 46 extend between intermediate wall 40 to side wall 32. Shelves 46 comprise Z-shaped members, each having a first leg 48 glued to intermediate wall 40 and a second leg 50 glued to side wall 32. Shelves 46 are oriented substantially parallel to bottom wall 24 of box 12 and are adapted to hold a plurality of secondary products 20 thereon. As seen from FIGS. 1 and 2, a plurality of adhesive tape dispensers 20 are stacked on shelves 46 and the second legs 50 prevent the dispensers from sliding of shelves 46 and out of second compartment 18. Gaps 52 are formed between section 42*a* and the second leg 50 of the top shelf 46, and between the second legs 50 of adjacent pairs of shelves 46. The tape dispensers 20 can be removed from second compartment 18 through gaps 52 (FIG. 2).

A pair of holes 54 may be formed in upper segment 42 of intermediate wall 40. Holes 54 are adapted to receive the legs (not shown) of a display sign (not shown) therein.

The display assembly 10 of the present invention is used in the following manner. At the factory, box 12 is formed, the rolls of wrapping paper 16 are inserted into first compartment 14 and the adhesive tape dispensers 20 are inserted into second compartment 18. Box 12 is sealed so that the rolls of wrapping paper 16 are held securely within first compartment 14 by upper section 12*b* and the adhesive tape dispensers 20 are enclosed within second compartment 18 by tongue 36. Box 12 is shipped to the retailer who then separates the upper and lower sections 12*a*, 12*b* of box 12 along perforations 34. Lower section 12*b* of box 12 is placed on a flat surface 56, such as a floor, so that bottom wall 24 rests on flat surface 56 and the rolls of wrapping paper 16 extend upwardly out of first compartment 14. This positioning makes it easy for the consumer to remove a roll of wrapping paper 16 from first compartment 14 and to replace the same therein if they change their mind. When upper section 12*a* of box 12 is detached, the tongue 36 is pulled away from side wall 32, leaving the adhesive tape dispensers 20 both visible and accessible to the consumer. If the consumer wishes to purchase an adhesive tape dispenser 20, they simply reach into second compartment 18 through one of the gaps 52, lift a dispenser 20 over the respective second leg 50 and withdraw the dispenser 20 through the gap 52. If the consumer changes their mind, it is easy to replace the dispenser 20 by pushing the same back through the gap 52 and placing it on a shelf 46. The display assembly of the present invention therefore makes it easy to ship and display a primary and secondary product together. Because both products are packaged and shipped together, there is no need for any setup on the part of the retailer, other than removal of the upper section 12*a* of the box 12 and positioning of the display 10 in an appropriate location in the store. Furthermore, no valuable shelf space is used to display either of the primary or secondary products. Furthermore, the primary and complementary secondary products are displayed together. Additionally, the display assembly provides for easy access to both the primary and secondary products and for replacement of the same should the consumer change their mind. This display assembly thereby enables the retailer to display the products in a neater and more compact fashion and requires less labor for setup and maintenance.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention are an example and the invention is not limited to the exact details shown or described.

The invention claimed is:

1. A shipping and display assembly comprising:

a first section having:

a first compartment adapted to receive a plurality of primary products therein; a second compartment adapted to receive a plurality of secondary products therein, the first section having a substantially continuous bottom wall which forms a bottom wall for both of the first and second compartments:

the first compartment having four side walls extending upwardly away from the bottom wall thereof; and wherein the bottom wall and side walls of the first compartment surround an interior cavity which has an opening disposed opposite the bottom wall thereof;

the second compartment having four side walls extending upwardly away from the bottom wall and having a top wall disposed opposite the bottom wall thereof; and wherein the side walls, bottom wall and top wall of the second compartment surround an interior cavity that has an opening formed in one of the side walls thereof and through which the interior cavity of the second compartment is accessible and wherein the first and second compartments abut each other and the first and second compartments have one of their side walls in common, the common side wall forming an intermediate wall between the first and second compartments; wherein a top portion of the intermediate wall is folded over to form the top wall of the second compartment;

a second section connected to the first section, the second section permanently removable from the connected first section to provide access to the first and second compartments;

wherein when the first and second sections are connected together the second section restrains the primary products within the first compartment and the secondary products within the second compartment; and when the second section is permanently removed from the first section, the primary products and secondary products are displayed in and removable from the first and second compartments; and, wherein an end portion of the top wall is folded downwardly to abut an inner surface of the side wall of the second compartment that is disposed opposite the intermediate wall; and wherein the end portion is secured to the inner surface thereof.

2. The shipping and display assembly as defined in claim 1, further comprising at least one shelf member extending between the intermediate wall and the side wall of the second compartment that is disposed opposite the intermediate wall.

3. The shipping and display assembly as defined in claim 2, wherein the at least one shelf member further includes a downwardly extending leg that lies in abutting contact with the intermediate wall and an upwardly extending leg that is disposed in abutting contact with the side wall of the second compartment disposed opposite the intermediate wall.

4. The shipping and display assembly as defined in claim 3, wherein the shelf member lies substantially parallel to the bottom wall of the second compartment.

5. The shipping and display assembly as defined in claim 4, wherein the side wall of the second compartment disposed opposite the intermediate wall has a portion cut away therefrom and said cut away portion forms the opening in that side wall of the second compartment.

6. The shipping and display assembly as defined in claim 5, wherein the cut away portion is substantially U-shaped.

7. The shipping and display assembly as defined in claim 6, wherein the first section is integrally formed with the second section and includes a plurality of perforations along which the first section is separable from the second section.

8. The shipping and display assembly as defined in claim 7, wherein the perforations on the side wall of the second compartment disposed opposite to the intermediate wall define the cut away portion on the first section and define a substantially identically shaped tongue on the second section.

9. The shipping and display assembly as defined in claim 1, wherein the first compartment is accessible from a first direction and the second compartment is accessible from a second direction perpendicular to the first direction.

* * * * *